US006406563B2

(12) United States Patent
Kawano et al.

(10) Patent No.: US 6,406,563 B2
(45) Date of Patent: Jun. 18, 2002

(54) STAINLESS SPHEROIDAL CARBIDE CAST IRON

(76) Inventors: Yutaka Kawano, 47-20 Kobata-akatsuka, Uji City, Kyoto; Shigenori Nishiuchi, 5-6-1005 Hanazono-cho, Kuzuha, Hirakata City, Osaka; Satoru Yamamoto, 11-6 Hayama-cho, Ichijoji, Sakyo-ku, Kyoto City, Kyoto; Seisuke Sugahara, 2-5-28 Mikuriya-minami, Higashi-osaka City, Osaka; Toshiyuki Kikuchi, 3-9-8-403 Honan-cho, Higashi, Toyonaka-city, Osaka, all of (JP)

( * ) Notice: Subject to any disclaimer, the term of this patent is extended or adjusted under 35 U.S.C. 154(b) by 0 days.

(21) Appl. No.: 09/794,818

(22) Filed: Feb. 26, 2001

Related U.S. Application Data

(63) Continuation-in-part of application No. 09/371,158, filed on Aug. 10, 1999, now abandoned.

(30) Foreign Application Priority Data

Apr. 28, 1999 (JP) ..... 11-122861

(51) Int. Cl.[7] ..... C22C 37/04; C22C 37/08

(52) U.S. Cl. ..... 148/324; 148/325; 148/327; 420/12; 420/15; 420/54; 420/69; 420/70; 420/100

(58) Field of Search ..... 148/324, 325, 148/327; 420/12, 15, 54, 70, 69, 100

(56) References Cited

U.S. PATENT DOCUMENTS 2,709,132 A * 5/1955 Giles ..... 420/12
5,225,007 A * 7/1993 Hattori et al. ..... 148/324
5,795,540 A * 8/1998 Dwars et al. ..... 420/12

* cited by examiner

*Primary Examiner*—Deborah Yee
(74) *Attorney, Agent, or Firm*—Curtis L. Harrington

(57) ABSTRACT

The present invention relates to stainless spheroidal carbide cast iron is such: comprises Fe as its main component;, C 0.6~4.0% and V 4~15% as its necessary components, P 0.01~0.15%, S 0.01~0.05%, and Al 0.05~1.0% as bubble assistants, and Ni 4~15%, Si 0.2~4.5%, Cr 13~30%, and Mn 0.2~1.5% as anticorrosion matrix formers in weight %; produced by the process that minute spheroidal space of gas (hydrogen) bubble is dispersed substantially equally into molten metal positively by high temperature melting at 1950~2073 K which is the bubbling reaction temperature, and spheroidal vanadium carbide of a covalent bond is crystallized inside of the spheroidal space, which has special characteristics such as corrosion-resistance, heat-resistance, abrasion-resistance, toughness and processing ability. Such improving its characteristics such as heat-resistance and corrosion-resistance can be applied within a wide areas of industries such as chemical industry, machinery, shipping and petrochemical industry which efficiency and functions are getting high in accordance with the development of the industries.

6 Claims, 13 Drawing Sheets

(1) (2) (3) (4)

(a)

(1) (2) (3) (4) (5)

(b)

(1) (2) (3) (4)

50 μm

50 μm

50 μm

50 μm

50 μm

50 μm

50 μm

50 μm

STAINLESS SPHEROIDAL CARBIDE CAST IRON

This application is a continuation-in-part of case Ser. No. 09/371,158, filed Aug. 10, 1999, now abandoned.

TECHNICAL FIELD OF THE INVENTION

The present invention relates to stainless spheroidal carbide cast iron and its object is to provide stainless spheroidal carbide cast iron which has special characteristics such as corrosion-resistance, heat-resistance, abrasion-resistance, thoughness and processing ability. Such stainless spheroidal carbide cast iron improving its characteristics such as heat-resistance and corrosion-resistance can be applied within a wide areas of industries such as chemical industry, machinery, shipping and petrochemical industry which efficiency and functions are getting high in accordance with the development of the industries.

BACKGROUND ART

Up to the present, pieces of apparatus such as boiler equipments and chemical plant instruments used in high temperature environment require materials with heat-resistance and corrosion-resistance. However in these days, more resistance under more severe conditions is required as the advancement of high temperature equipments, better functioning and becoming highly efficient in each area of the industries including chemical industry are remarkable. For example, in an area of injection molding of engineering plastic, ceramic, reinforcements like FPR and all kinds of additives are added into the resin in order to raise strength, fire-resistance and abrasion-resistance of resin moldings. As a result, with the ceramic being fragile, the resin molding system is easy to be abraded because of the reinforcement within the cylindrical resin, and it further becomes easy to corrode with a corrosive gas generated from the additives. Also, since shapes of parts manufactured in all kinds of industries such as car industry are getting complex, abrasion of manufacturing apparatuses has become more severe than ever.

With the industries developing dramatically, strength, heat-resistance, abrasion-resistance, corrosion-resistance, and processing ability of materials are required to be higher than prior ones in surroundings where the apparatuses are used severely.

Firstly, a usage of white cast iron which is strong cast iron can be considered in order to obtain outstanding abrasion-resistance. Said white cast iron consisting no graphite within its organization has a defect that it is very fragile, being formed with pearlite and cementite. Therefore, it is not easy to obtain outstanding abrasion-resistance in the usage of the white cast iron. That's why a usage of spheroidal graphite cast iron with toughness, conquering the defect of white cast iron, is on trial.

Said spheroidal graphite cast iron wherein a configuration of flake graphite crystallized in its organization is spheroidal in shape has outstanding toughness because the configuration of crystallized substance in the organizations of metallic materials gives a great influence on toughness. That is to say that generally, the configuration of a crystallized substance bonds covalently or couples electro statically, becoming a facet and platen in shape always when it has a strong anti-metal characteristic. In this circumstance, thoughness is weak. Contrarily, when a characteristic of metal is strong, the configuration of a crystallized substance bonds metallically, becoming a nonfacet granular or spheroidal dendrite. In these circumstances, toughness is strong due to a dispersion of force even when being given an impact from an outside. In a case of the spheroidal graphite cast iron, it has outstanding toughness because the configuration of the flake graphite crystallized within the organization of cast iron is made to be spheroidal in shape with more than 0.04% of magnesium (Mg) being composed. However, it is difficult to hold both strong toughness and abrasion-resistance.

On the other hand, the present inventors have already disclosed that alloy cast iron with outstanding abrasion-resistance and impact-resistance can be obtained by crystallized spheroidal or granular V-C system carbide and Fe-Cr system carbide within the organization of cast iron in Japanese patent application No.9-307951.

PROBLEMS TO BE SOLVED BY THE INVENTION

Said spheroidal graphite cast iron has outstanding abrasion-resistance and toughness, however, it also has a defect that is inferior in corrosion-resistance. Further, the alloy cast iron disclosed in the Japanese patent application No. 9-307951 is outstanding in abrasion-resistance and impact-resistance; however, it also has a defect that it is a little inferior in corrosion-resistance and heat-resistance. The cast iron with all of abrasion-resistance, toughness, corrosion resistance, heat-resistance and processing ability has not been obtained yet. Therefore, an invention of cast iron which has outstanding corrosion-resistance and heat-resistance in addition to abrasion-resistance and toughness of the spheroidal graphite cast iron and the alloy cast iron disclosed in the Japanese patent application No. 9-307951 is desired.

Incidentally, stainless steel is known as a steel material with outstanding corrosion-resistance. Concretely, there is stainless steel prescribed with JJSG 5122 as follows; SCS12, SCS13, SCS19, and SCS21 of representative 18Cr-8Ni system, SCS14 of 18Cr-11Ni-Mo system, SCS11 of high Cr-Ni system, SCS1 and SCS2 of 13Cr, and high Cr system. These kinds of stainless steel comprise more than 12% of Cr and has the structure which protects from rust with a surface of steel wherein precise oxide such as FeO, $Cr_2O_3$ and NiO is crystallized after passivation caused by oxygenation of Cr.

Also, said stainless steel such as 18Cr-8Ni system has outstanding heat-resistance in addition to outstanding corrosion-resistance, thus it is used as heat-resisting steel widely in the field of boilers, turbines and jet engines. These kinds of stainless steel composed with Cr which rises recrystallization temperature and makes creep strength larger by depositing carbide and nitride. The necessary proportion of proposed Cr is 8% when working temperature is below 700° C. and is more than 20% when working temperature is at 1000° C.

Then, after continuing a devoted study of the alloy cast iron further, the present inventors have come to invent that not only abrasion-resistance and toughness but also outstanding corrosion-resistance and heat-resistance which are equal to what the stainless steel has and outstanding processing ability, can be given by crystallizing only spheroidal VC carbide, and that corrosion-resistance and heat-resistance can be improved more by mixing specific amount of special additives apart from necessary components.

SUMMARY OF THE INVENTION

The invention as set forth in claim 1 relates to stainless spheroidal carbide cast iron: comprising of Fe as its main component, C 0.6~4.0% and V 4~15% as its necessary components, P 0.01~0.15%, S 0.01~0.05%, and Al 0.05~1.0% as bubble assistants and Ni 4~15%, Si 0.2~4.5%, Cr 13~30%, and Mn 0.2~1.5% as anticorrosion matrix formers in weight %; produced by the process that minute spheroidal space of gas (hydrogen) bubble is dispersed substantially equally into molten metal positively by high temperature melting at 1950~2073 K which is the bubbling reaction temperature, and spheroidal vanadium carbide of a covalent bond is crystallized inside of the spheroidal space.

The invention as set forth in claim 2 relates to the stainless spheroidal carbide cast iron: comprising of Fe as its main component, C 0.6~4.0% and V 4~15% as its necessary components, P 0.01~0.15%, S 0.01~0.05%, and Al 0.05~1.0% as bubble assistants, and Si 0.2~4.5%, Cr 13~30%, Mn 0.2~1.5%, and Ni and/or Co 4~15% as anticorrosion matrix formers in weight %; produced by the process that minute spheroidal space of gas (hydrogen) bubble is dispersed substantially equally into molten metal positively by high temperature melting at 1950~2073 K which is the bubbling reaction temperature, and spheroidal vanadium carbide of a covalent bond is crystallized inside of the spheroidal space.

The invention as set forth in claim 3 relates to the stainless spheroidal carbide cast iron as set forth in claim 1 comprising a mixture of said alloy elements and at least more than one kind selected from additives (a)~(d) as follows: (a) Mo 0.05~15%; (b) Ti 0.01~5%; (c) B 0.01~2%; and (d) at least more than two kinds of alloy elements selected from Cu, W, Zr, Co, Nb, Ta and Y 0.2~5%.

The invention as set forth in claim 4 relates to the stainless spheroidal carbide cast iron as set forth in claim 2 comprising a mixture of said alloy elements and at least more than one kind selected from additives (a)~(d) as follows: (a) Mo 0.05~15%; (b) Ti 0.01~5%; (c) B 0.01~2%; and (d) at least more than two kinds of alloy elements selected from Cu, W, Zr, Co, Nb, Ta and Y 0.2~5%.

The invention as set forth in claim 5 relates to the stainless spheroidal carbide cast iron as set forth in claim 1 comprising a mixture of said alloy elements and at least more than one kind selected from additives (a)~(d) as follows: (a) Mo 0.05~5%; (b) Ti 0.01~1.0%; (c) B 0.01~0.5%; (d) at least more than two kinds of alloy elements selected from Cu, W, Zr, Co, Nb, Ta and Y 0.2~10%.

The invention as set forth in claim 6 relates to the stainless spheroidal carbide cast iron as set forth in claim 2 comprising a mixture of said alloy elements and at least more than one kind selected from additives (a)~(d) as follows: (a) Mo 0.05~5%; (b) Ti 0.01~1.0%; (c) B 0.01~0.5%; (d) at least more than two kinds of alloy elements selected from Cu, W, Zr, Co, Nb, Ta and Y 0.2~10%.

Providing this invention can solve said all problems.

DETAILED DESCRIPTION OF THE INVENTION

Figure 1:
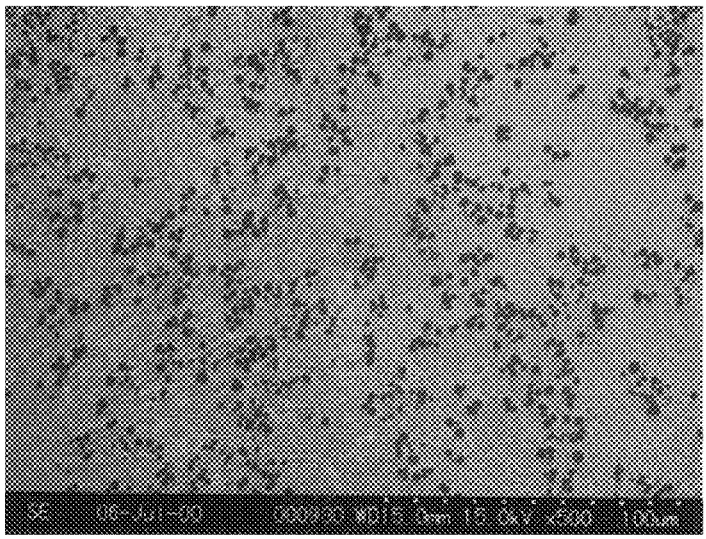
FIG. 1 is a micrograph of 500 times showing one example of geometrical spheroid in the present invention.
Figure 2:
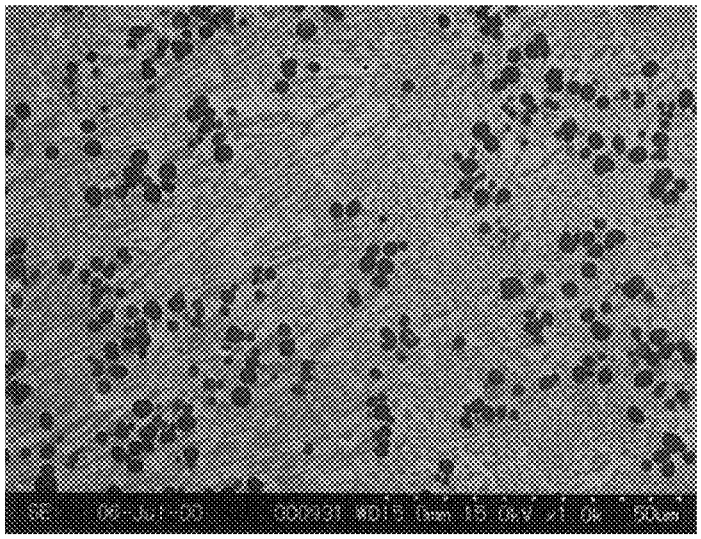
FIG. 2 is a micrograph of 1,000 times showing one example of geometrical spheroid in the present invention.
Figure 3:
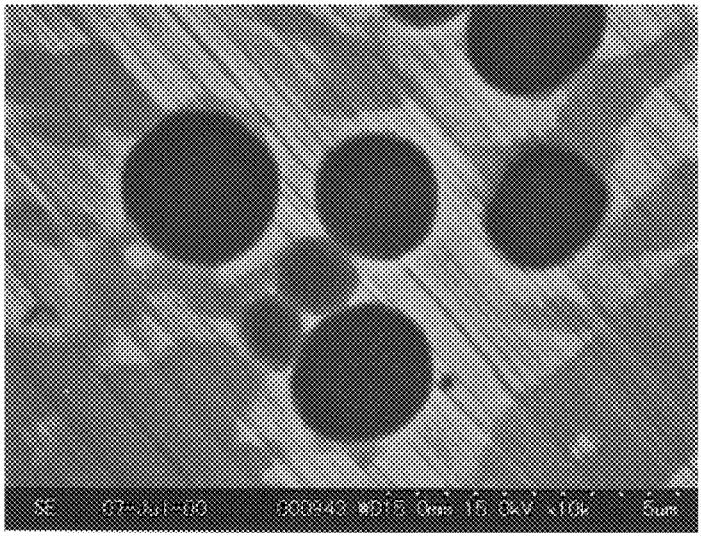
FIG. 3 is a micrograph of 10,000 times showing one example of geometrical spheroid in the present invention.
Figure 4:
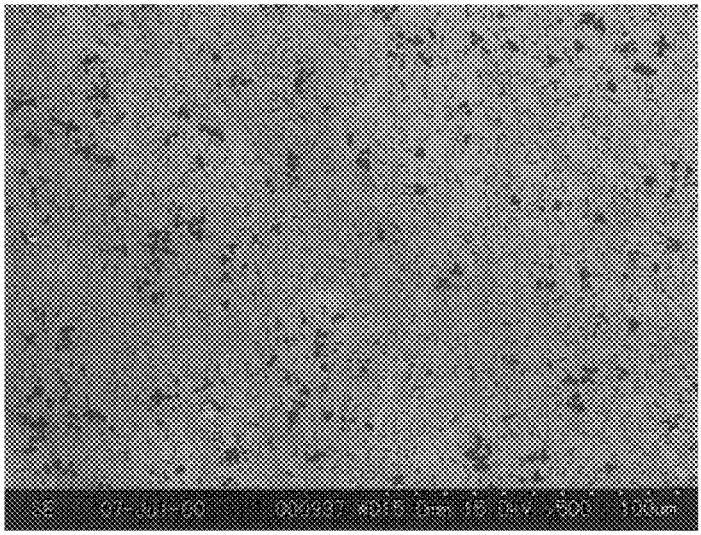
FIG. 4 is a micrograph of 500 times showing one example of granularity or lump in metal histology.
Figure 5:
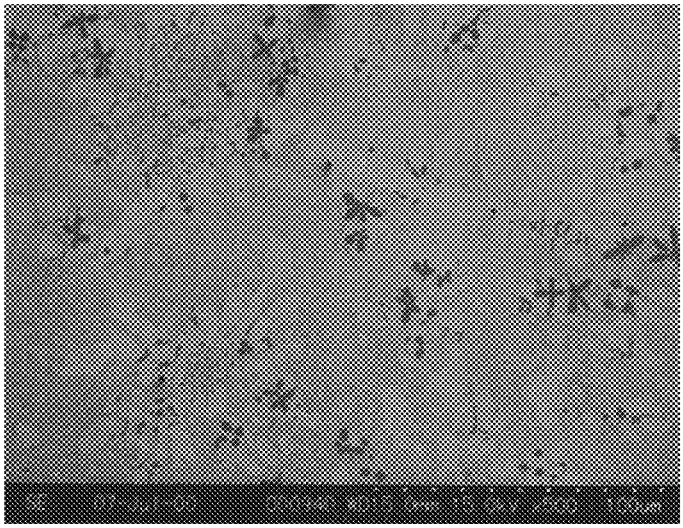
FIG. 5 is a micrograph of 1,000 times showing one example of granularity or lump in metal histology.
Figure 6:
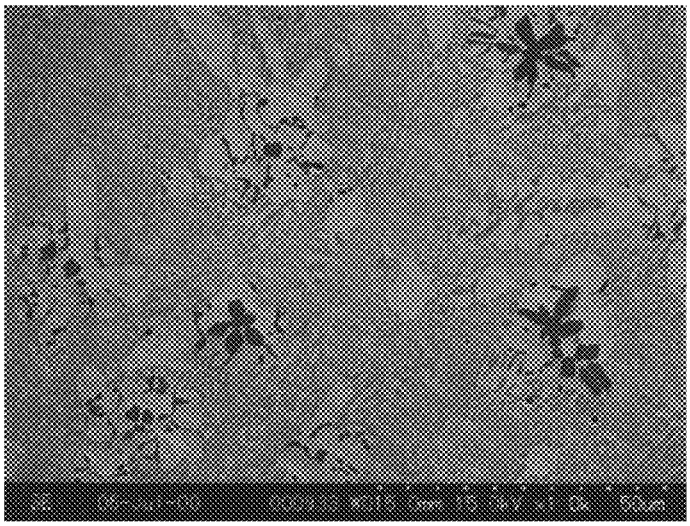
FIG. 6 is a micrograph of 10,000 times showing one example of granularity or lump in metal histology.

Hereinafter, it is described on the stainless spheroidal carbide cast iron relating to the present invention. On the stainless spheroidal carbide relates to the present invention, the stability and instability of system are decided by using "quantum fluctuation" arrived by the method of molecular orbital on quantum mechanics as fundamental concept. Based on the above, alloy composition and reaction temperature are decided; in addition, by coexisting bubble resource component and high temperature melting at 1950~2073 K which is the bubbling reaction temperature, minute spheroidal space of gas (hydrogen) bubble is dispersed into molten metal positively and spheroidal vanadium carbide of a covalent bond is substantially equally dispersed inside of the spheroidal space. Consequently, the stainless spheroidal carbide cast iron having the metallic composition, which is superior in processing ability and durability, is obtained. The stainless spheroidal carbide cast iron relating to the present invention comprises: Fe as its main component; C and V as its necessary components; P, S and Al as bubble assistants; and Cr, Ni, Si, Mn as anticorrosion matrix formers, wherein spheroidal vanadium carbide is dispersed substantially equally.

Hereinafter, unit of content is in weight % except with special mention. And "spheroidal" in this specification means that the shape is "spheroidal" in the notion of geometry, but is distinguished from "granular" and "lump" in metal histology. The present inventors provide material of stainless spheroidal carbide cast iron wherein "spheroidal" carbide is equally dispersed, but not "granular" and "lump" carbide. In FIGS. from 1 to 3, one example of "spheroidal" in the notion of geometry is shown, respectively. And in FIGS. from 4 to 6, one example of "granular" or "lump" in metal histology is shown, respectively.

Alloy composition and melting method are important to form spheroidal carbide. This reason is because that when cast iron is melted as usual method, flat plate of $M_7C_3$ type carbide is formed; but spheroidal carbide is not formed. To inhibit forming of flat plate of $M_7C_3$ type carbide and to form spheroidal carbide, high temperature melt may be carried out. At low temperature flat plate of $M_7C_3$ type carbide is formed. On the other hand, at high temperature, new spheroidal carbide is formed and forming of flat plate of $M_7C_3$ type carbide is inhibited. New spheroidal carbide which is formed by the high temperature melt is vanadium carbide (hereinafter called VC carbide).

The reason of which spheroidal vanadium carbide is formed by the high temperature melt can be explained by quantum mechanically evaluating the stability of alloy system. In addition, the stability of alloy system can be explained by calculating "cohesive energy" and "energy fluctuation".

"Cohesive energy" can be given by subtracting from total energy of a system to sum of energy of isolated atoms where the energy of an isolated atom itself is given by the sum of the ionization energy of each electron.

"Energy fluctuation" (ΔE) is obtained, as shown in following equation, as the standard deviation of orbital energy (En) of all vacant orbit not occupied molecular wherein the highest occupied molecular orbital (HOMO) energy on ground state is as the standard. (Note: the possibility of which electron is excited is followed by Gibbs distribution.)

$$\Delta E^2 = \langle (En - \langle En \rangle)^2 \rangle$$

$$\langle En \rangle = \sum_n En \exp(-En/kT) \Big/ \sum_n \exp(-En/kT)$$

(Where ΔE is Energy fluctuation, En is orbital energy, and <En> is average of orbital energy.)

It is understood that "cohesive energy" expresses the static stability of system, whereas "energy fluctuation" (ΔE) defined as above expresses tendency of which electron is excited; in other words, reactivity (activity).

Figure 7:
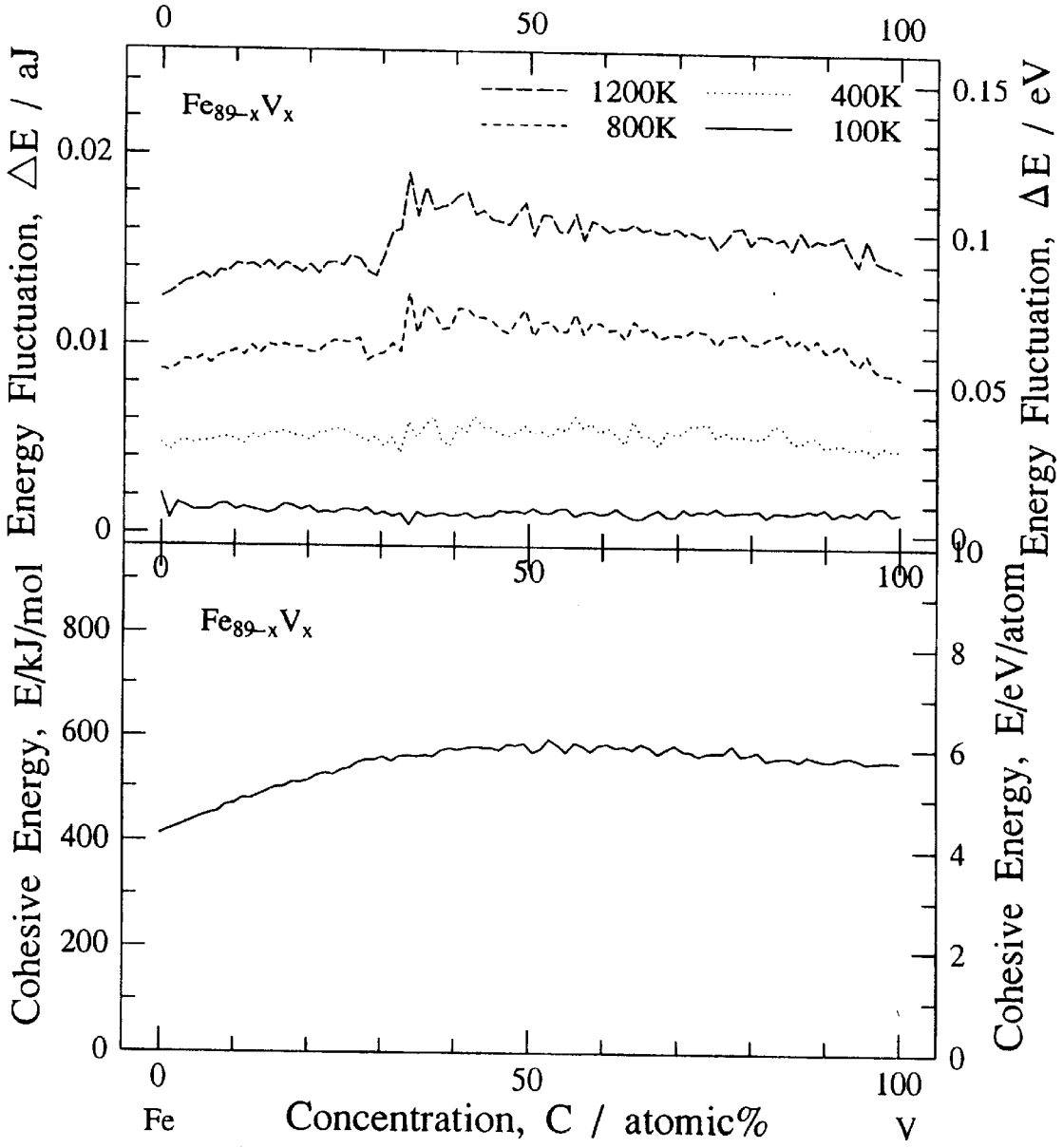
FIG. 7 is a graph showing the calculated result of energy fluctuation and cohesive energy when Fe atom is randomly substituted to V.
Figure 8:
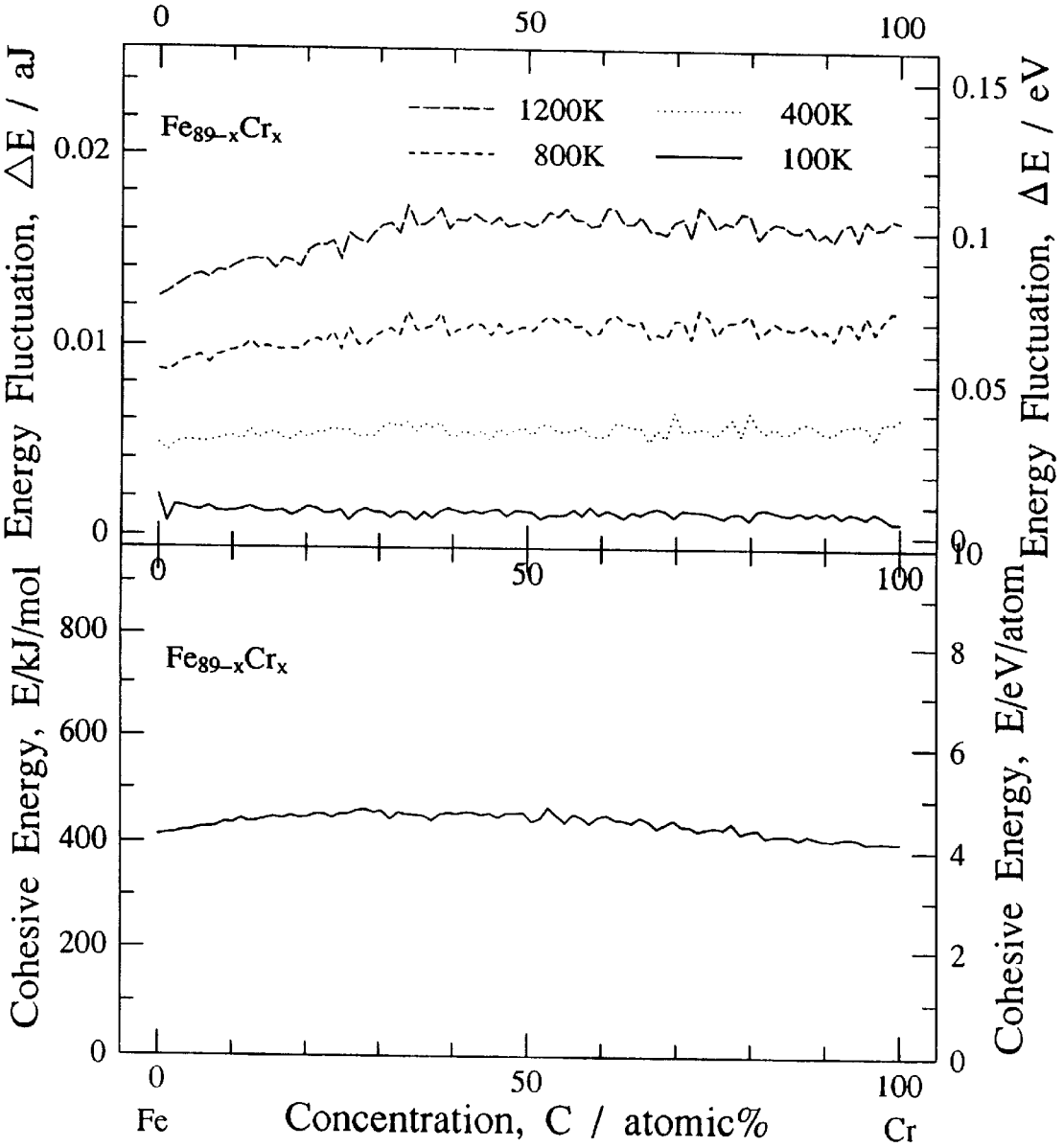
FIG. 8 is a graph showing the calculated result of energy fluctuation and cohesive energy when Fe atom is randomly substituted to Cr.

To calculate these concretely, the Schrödinger wave equation $H\Psi = E\Psi$ is numerically calculated by computer with using the extended Hückel method. In the cluster of 89 pieces of Fe atoms, calculated results of cohesive energy and energy fluctuation when Fe atoms are randomly substituted by V or Cr are shown in FIG. 7 and FIG. 8.

As the result, it finds that the changing of "cohesive energy" slowly when Fe atoms are substituted by V or Cr at random. Also, it finds that the increasing "energy fluctuation" as the temperature becomes higher. In addition, it finds that when V is added to Fe, energy fluctuation rapidly becomes bigger at high temperature in comparison with when Cr is added to Fe. This means, in Fe-V binary system, it is rapidly unstabilized at high temperature and the reactivity increases. In other words, when the temperature becomes high, the unstabilized Fe-V binary system rapidly stabilizes with reacting a formation of VC carbide. On the other hand, since $M_7C_3$ type carbide exists just at low temperature but can not exists at high temperature, it is possible that forming just spheroidal VC carbide while the formation of ordinary $M_7C_3$ type carbide is inhibited with utilizing the rapid formation reaction of VC carbide at high temperature. That is, in order to form the spherical VC carbide, C and V are indispensable, and its desired addition is 1:1 in the ratio of atomic number, and 1:4 in the ratio of weight.

Next, spheroidizing of VC carbide formed by melting at high temperature depends on gas (hydrogen) bubble, as it is understood from the graphite spheroidizing theory of spheroidal graphite cast iron. That is, it is required that minute gas (hydrogen) bubble is made to generate inside of melted cast iron and it is made to disperse. V, which has a property being easy to absorb hydrogen, is utilized for this. V is a favorable element for hydrogen occlusion as clear from the study of hydrogen occlusion alloy. And in order to disperse hydrogen bubble released form V minutely, it is indispensable that P and S of low boiling point elements and Al raised dispersion of minute gas (hydrogen) bubble are added with small amount. Adding these elements and melting at high temperature vaporize P and S, which are low boiling point elements, and Al activates the dispersion of minute hydrogen bubble so that it is possible to form entire spheroidal carbide. In addition, in order to ensure the ability of casting for cast iron, it is required that the right amount of C and V are added, and in order to improve its corrosion-resistance, toughness and heat-resistance, it is required that the right amount of Ni, Si, Cr, Mn and so on are added.

As the above, it is impossible to form the spheroidal carbide by just melting alloy material as an ordinary method. In order to form the spheroidal carbide, it is required that minute spheroidal space of gas (hydrogen) bubble is made to disperse into molten metal positively and spheroidal carbide of a covalent bond is made to form inside of the spheroidal space.

Figure 9:
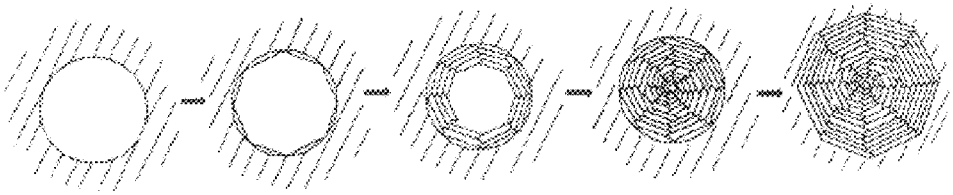
FIGS. 9(A) and (B) are models showing the generation process of the spheroidal carbide
Figure 9:
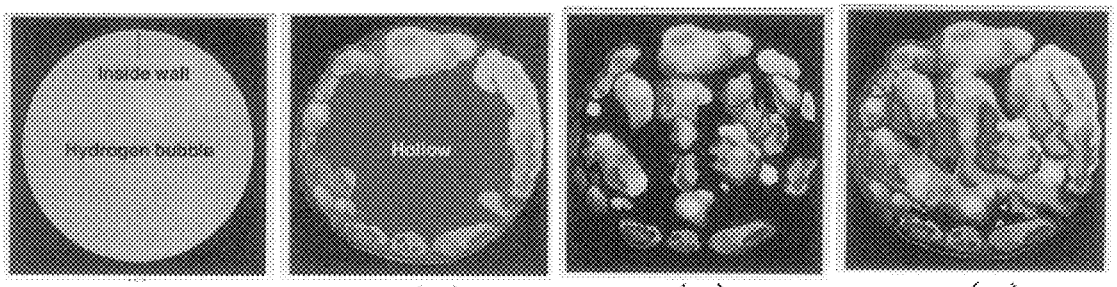
Figure 10:
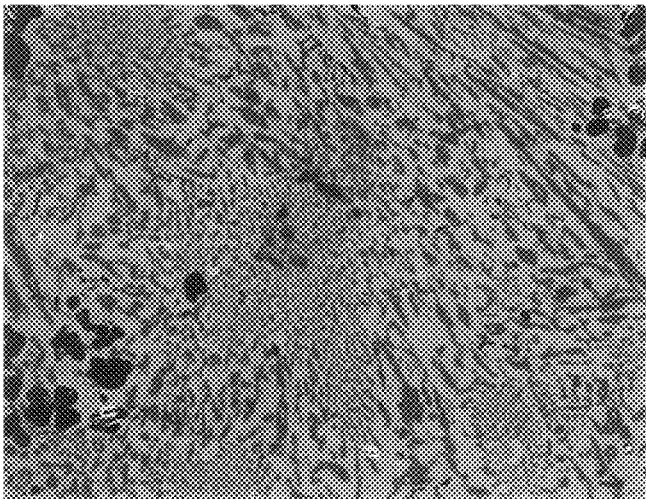
FIG. 10 is a micrograph of the metallic organization of comparative example 1, wherein 1.7 cm is actual 50 μm.
Figure 11:
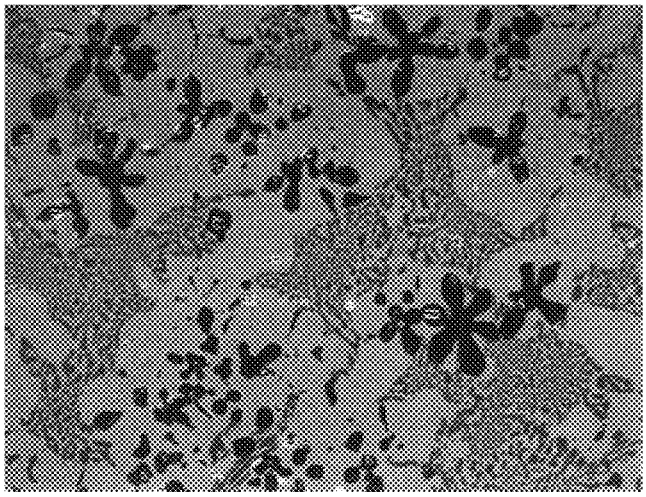
FIG. 11 is a micrograph of the metallic organization of comparative example 2, wherein 1.7 cm is actual 50 μm.
Figure 12:
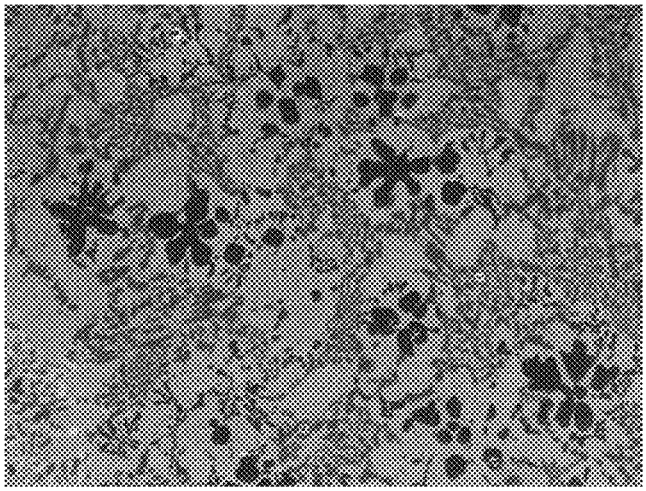
FIG. 12 is a micrograph of the metallic organization of comparative example 3, wherein 1.7 cm is actual 50 μm.
Figure 13:
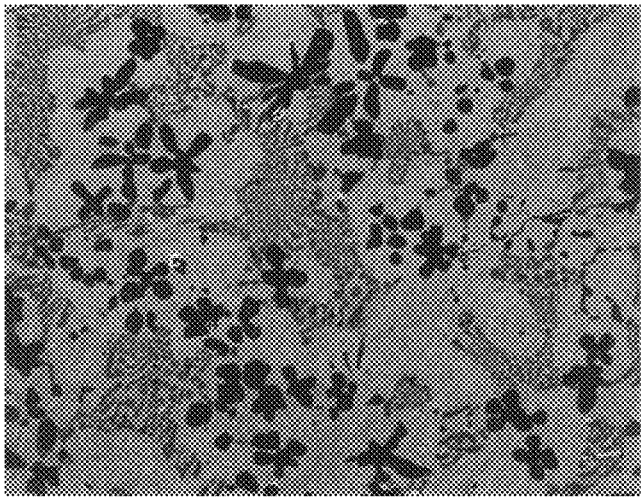
FIG. 13 is a micrograph of the metallic organization of comparative example 4, wherein 1.7 cm is actual 50 μm.
Figure 14:
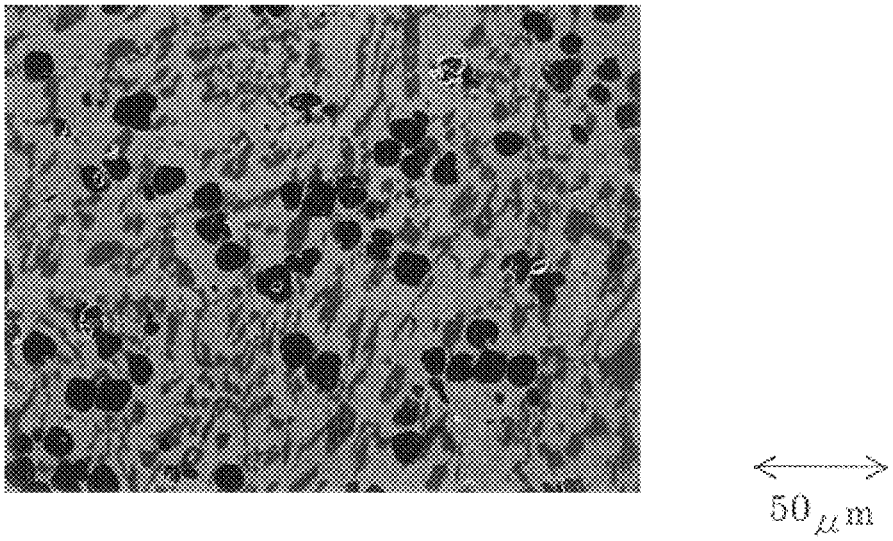
FIG. 14 is a micrograph of the metallic organization of embodiment 1, wherein 1.7 cm is actual 50 μm.
Figure 15:
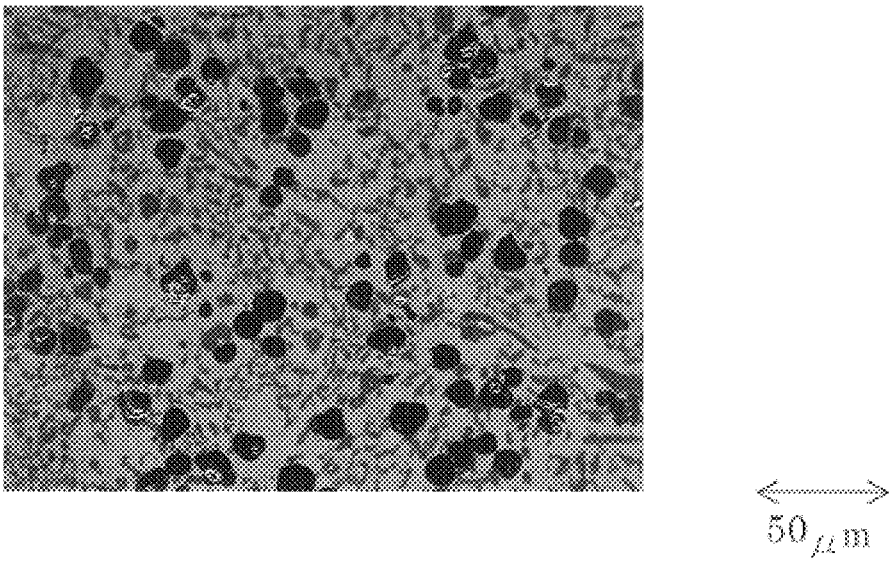
FIG. 15 is a micrograph of the metallic organization of embodiment 2, wherein 1.7 cm is actual 50 μm.
Figure 16:
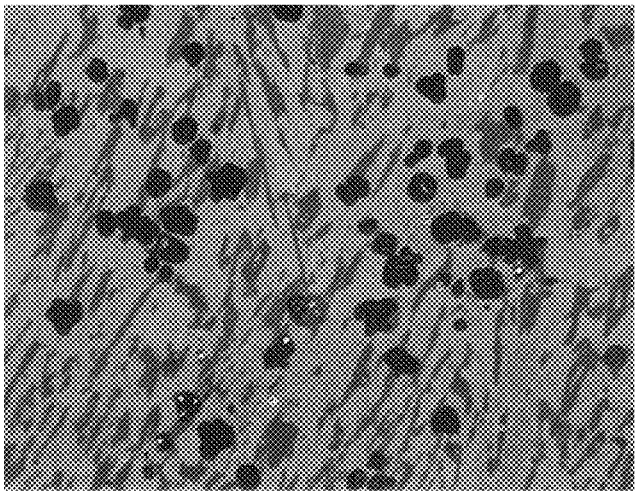
FIG. 16 is a micrograph of the metallic organization of embodiment 3, wherein 1.7 cm is actual 50 μm.
Figure 17:
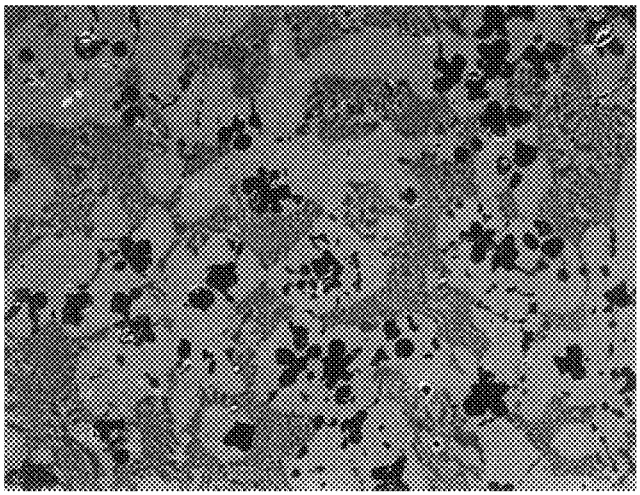
FIG. 17 is a micrograph of the metallic organization of comparative example 5, wherein 1.7 cm is actual 50 μm.
Figure 18:
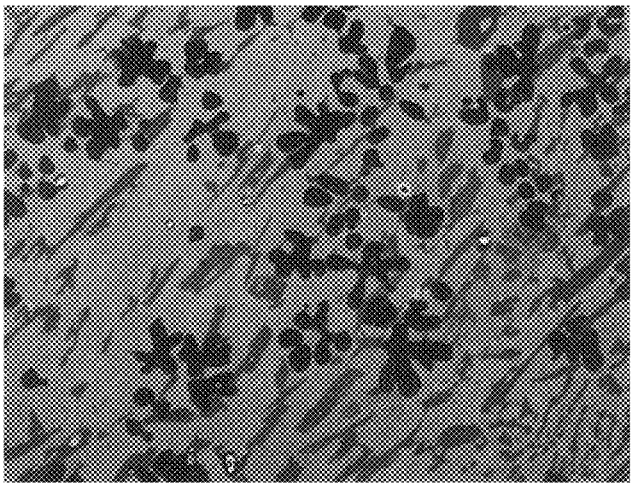
FIG. 18 is a micrograph of the metallic organization of comparative example 6, wherein 1.7 cm is actual 50 μm.
Figure 19:
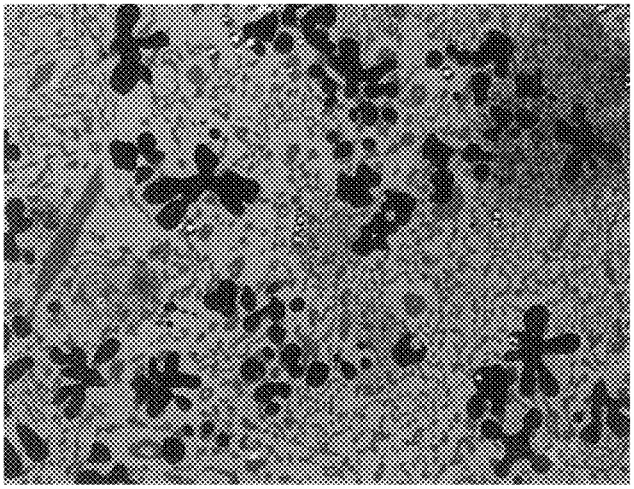
FIG. 19 is a micrograph of the metallic organization of comparative example 7, wherein 1.7 cm is actual 50 μm.
Figure 20:
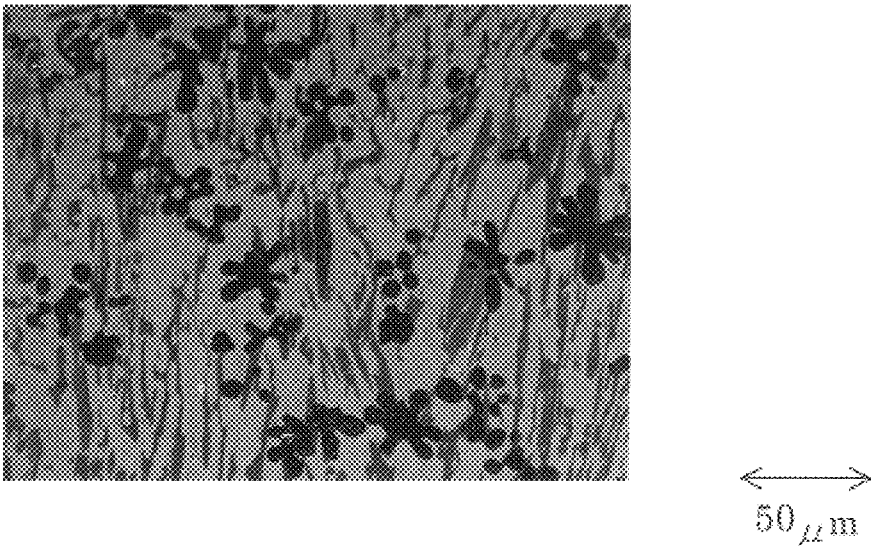
FIG. 20 is a micrograph of the metallic organization of comparative example 8, wherein 1.7 cm is actual 50 μm.

A model of forming process of spheroidal carbide is shown in (a) (b) of FIG. 9. First, the minute VC covalent bonded crystal grows along the bubble boundary (2) in minute spheroidal space (1) which is formed in the metallic organization. When the grown-up tips collide each other, it becomes granularity and grows more inside of the bubble (3). By repeating this, the spheroidal VC carbide whereof the outward shape is a spheroidal shape and which has the inner structure as that a reticular surface is piled radially generates when the spheroidal bubble is buried to the minute VC covalent bonded crystal (4, 5).

The stainless spheroidal carbide cast iron related to the present invention has characteristics of corrosion-resistance, abrasion-resistance, heat-resistance, toughness, casting ability, processing ability, welding ability, and so on while all of these characteristics very relate to that carbide is spheroidal. That is to say, the corrosion of material is advanced at phase boundary; however, on this case, the phase boundary is closed spheroidally so that the advance of corrosion is inhibited. The abrasion-resistance is guaranteed by the presence of hard phase; however, crack of the material is advanced from the phase boundary. Thus, advance of the crack is also inhibited by what phase is spheroidal. In addition, if the shape is spheroidal, occurrence of stress-concentration is also eased, and characteristics of heat-resistance and toughness are added. Since it is spheroidal, processing ability is improved in comparison with flat plate carbide and accuracy of processing is raised.

As described above, in order to obtain the spheroidal carbide, the melting method is important and it is required to carry out at very high temperature than the one in ordinary melting of cast iron. In other words, it is melted at the bubbling reaction temperature that generates minute gas (hydrogen) bubble inside of the melted cast iron; concretely, 1950~2073 K, preferably 1953~2023 K, more preferably 1973~2053 K. When the melting temperature is less than 1950 K, minute gas (hydrogen) bubble is not dispersed so spheroidal VC carbide is not formed, the $M_7C_3$ carbide crystallized in the matrix. When exceeding 2073 K, since the durability of the fireproof furnace material declines and the oxidation decreasing of molten metal is made to increase, neither cases are preferable. Moreover, the component which is shown below is contained in the stainless spheroidal carbide cast iron related to the present invention.

Firstly, the purpose of mixing C and V is to improve abrasion-resistance while spheroidal or granular carbide of V-C system is crystallized.

The content of Carbon (C) should be 0.6~4.0%, preferably 1.5~3.5more preferably 2.3~3.3%. When less than 0.6% of C composed, hardness and mechanical property of the alloy cast iron does not change much. However, when more than 0.6% of C composed, hardness and mechanical property of the alloy cast iron improve, but composing of more than 4% of C not only makes C change to platen carbide of Fe-Cr system (i.e. cementite) but also lowers its thoughness, corrosion-resistance and heat-resistance.

The content of Vanadium (V) should be 4.0~15%, preferably 5~13%, more preferably 8~12%. When less than 4.0% of V composed, spheroidal carbide of V-C system cannot be crystallized because of dispersion of the carbide which is very hard, and no better effect can be expected with composing of more than 15% of V that would easily segregate. Neither of the above cases is desirable. It should that the content of V is as 3~6 times in weight, preferably 3.5~5.5 times in weight more preferably about 4 times in weight of content of C, since the ratio of atomic number is about 1:1 (weight ratio 4:1) in spheroidal VC carbide.

Phosphorus (P), Sulfur (S), and Aluminum (Al) are contained as bubble assistants. P and S are low boiling point elements, evaporate in the high temperature melting cast iron, and generate minute gas (hydrogen) bubble. Al is contained to raise dispersion the bubble.

The content of Phosphorus (P) should be 0.01~0.15%, preferably 0.04~0.13%, more preferably 0.08~0.12%. This reason is: if it is less than 0.01%, the effect to disperse bubble is not expected; and the other hand, if exceeding 0.15% , segregation and brittleness may happen; therefore, neither cases are preferable.

The content of Sulfur (S) should be 0.01~0.05%, preferably 0.015~0.03%. This reason is: if it is less than 0.01%, the effect to disperse bubble is not expected; and if it is more than 0.05%, MnS (Manganese Sulfide) becomes to be easily crystallized and corrosion-resistance decreases; therefore, neither cases are preferable.

Aluminum (Al) demonstrates the effect to disperse minute hydrogen bubble when it compounds with P and S. The content of Aluminum (Al) should be 0.05~1.0%, preferably 0.08~0.8%, more preferably 0.1~0.5 %. This reason is: if the content is less than 0.05%, since the affinity with oxygen is strong, it becomes deoxidation element and the effect by compound can not be obtained; and if the content is more than 1.0%, it makes fluidity decline and the casting ability deteriorates; therefore, neither cases are preferable.

Nickel (Ni), Silicon (Si), Chromium (Cr) and Manganese (Mn) are anticorrosion matrix formers, in other words, they are compounded for improvement of corrosion-resistance, heat-resistance, and thoughness.

The content of Ni should be 4.0~15%, preferably 5.0~13%, more preferably 7~10%. This reason is: if the content is less than 4.0%, it occurs metallic organization to be martensite and it becomes to be hard and to brittle; and the other hand, if exceeding 15% , segregation is promoted and a base becomes to be weak; therefore, neither cases are preferable.

Silicone (Si) is the effective element to the heat-resistance and can make the oxidation decreasing decrease remarkably. The content of silicone should be 0.2~4.5%, preferably 0.5~4.0%, more preferably 1.0~3.0%. This reason is: if the it is less than 0.2%, the effect by the Si containing can not be shown because of aggravating of the yield of V, whereas thoughness decreases when exceeding 4.5%; therefore, neither cases are preferable.

The content of Cr should be 13~30%, preferably 13~25%, more preferably 16~20%. When less than 13% of Cr composed, stable austenite (γ) cannot be crystallized with decreasing heat-resistance and corrosion-resistance against oxidizing solution. On the other hand, with composing of more than 30% of Cr, flat plate carbide is crystallized with segregation causing a deterioration of strength. Neither of the above cases is desirable.

When mixing Manganese (Mn), its content should be 0.2~1.5%, preferably 0.3~1.2%, more preferably 0.4~1.0%. Composing of more than 1.5% of $M_7C_3$ is not desirable for the alloy cast iron of V-C system as it easily segregates.

The above mentioned elements are the necessary components that are included with iron (Fe) which is a main component. In the present invention, at least more than one kind selected from additives (a)~(d) as follows: (a) Mo; (b) Ti; (c) B; and (d) at least more than 2 kinds of alloy elements selected from Cu, W, Zr, Co, Nb, Ta and Y, can be mixed within said necessary components as one please.

Molybdenum (Mo) is effective in preventing deposition of graphite and in stabilizing the base. When mixing Mo, its content should be 0.05~15%, preferably 0.1~13%, more preferably 1.0~7.0%. Composing of both less than 0.05% of Mo wherein Mo cannot be as effective as said previously and more than 15% of Mo wherein spheroidal carbide of V-C system cannot be crystallized stably because of dispersion of the carbide which is very hard with deterioration of corrosion-resistance are not desirable.

Furthermore, if the improvement of heat-resistance is desired particularly, the content of Mo should be 0.05~5% because composing of more than 5% of Mo deteriorates the heat-resistance a little.

Titanium (Ti) is effective in denitrification and in refining the organization of alloy cast iron. When mixing Ti, its content should be 0.01~5.0% , preferably 0.05~4.5% , more preferably 0.1~3.5% . Composing of both less than 0.01% of Ti wherein Ti cannot refine effectively and more than 5.0% of Ti wherein making carbide of V-C system to be spheroidal in shape is deteriorated with increased deposition of Ti are not desirable.

Furthermore, if the improvement of heat-resistance is desired particularly, the content of Ti should be 0.01~1.0% because composing of more than 1.0% of Ti deteriorates the heat-resistance a little.

Boron (B) is effective for increasing hardness in a heat treatment. When including B, its content should be 0.01~2.0%, preferably 0.05~1.5%, more preferably 0.1~1.0%. Composing of both less than 0.01% of B wherein B cannot be as effective as said previously and more than 2.0% of B causing a deterioration of strength are not desirable.

Furthermore, if the improvement of heat-resistance is desired particularly, the content of B should be 0.01~0.5% because composing of more than 0.5% of B deteriorates the heat-resistance a little.

Copper (Cu), Tungsten (W), Zirconium (Zr), Cobalt (Co) Niobium (Nb), Tantalum (Ta) and Yttrium (Y) can be included to meet purposes such as for the improvement of corrosion-resistance, abrasion-resistance and heat-resistance as one wishes. More than two kinds of these elements would be better to be included so that much more outstanding effects can be obtained even though the composing of one kind of these elements is effective. However, a random composition of these elements would not always make a covalent bond strong, so when an improvement of corrosion-resistance is desired, a total content of more than two kinds of elements should be 0.2~5% . Further, when an improvement of heat-resistance is desired, a total content of more than two kinds of elements should be 0.2~10%, as it is more effective to include larger amount of these elements.

Incidentally, to prevent metallic organization to be martensite, the combination of Cobalt (Co) which shows the same effect as Nickel (Ni) is effective. Especially, when improving abrasion-resistance, substituting the part or all of the content of Ni appropriately to Co is effective. That is, total content of Ni and Co is 4.0~15%, preferably 5.0~13%, more preferably 7~10%.

In the present invention, said composition components explained above can be included appropriately in addition to the necessary components: C, V, P, S, Al, Ni, Si, Cr, and Mn, to meet purposes as one wishes and they should be high temperature melted at 1950~2073 K and are cast. Particularly, it is effective to include: P, S, and Al for a stabilization of spheroidal VC carbide; Ni, Si, Cr and Mn for forming of anticorrosion matrix; Mo, Ti, B, Cu, W, Zr, Nb, Ta, Y and Co for corrosion-resistance, abrasion-resistance and making thoughness.

The stainless spheroidal cast iron comprising said composition can be obtained, as the usual method, by cooling and leaving of poured molten metal in a mold. Also, it is annealed for about two hours at 823±50 K because eliminating casting stress, which occurs at cooling is desirable. The leaving organization is an austenite (γ)+VC complex and heat treatment is not effective.

And, there are no differences between the alloy cast iron and its organization which are produced as left casting when they are treated with normalizing and annealing.

EMBODIMENT

Following is a detailed explanation of the stainless spheroidal cast iron disclosed in the present invention based on embodiments. Note that the present invention is not restricted to the following embodiments.

Conditions of Melting Production and Material to be Tested

After compounding each of alloy raw materials according to the composition of the mention in table 1 to pure iron (Fe), it melted with using 50 kg of high frequency induction furnace (ramming material $MgO+Al_2O_3$). After fusion beginning, micro organization observation test pieces (30ϕ× 100 L) were gathered to the sand mold in the following melting temperature. After casting, heat-treatment of air-cooling is carried out after maintaining for 1 hour at 973 K.

Figure 22:
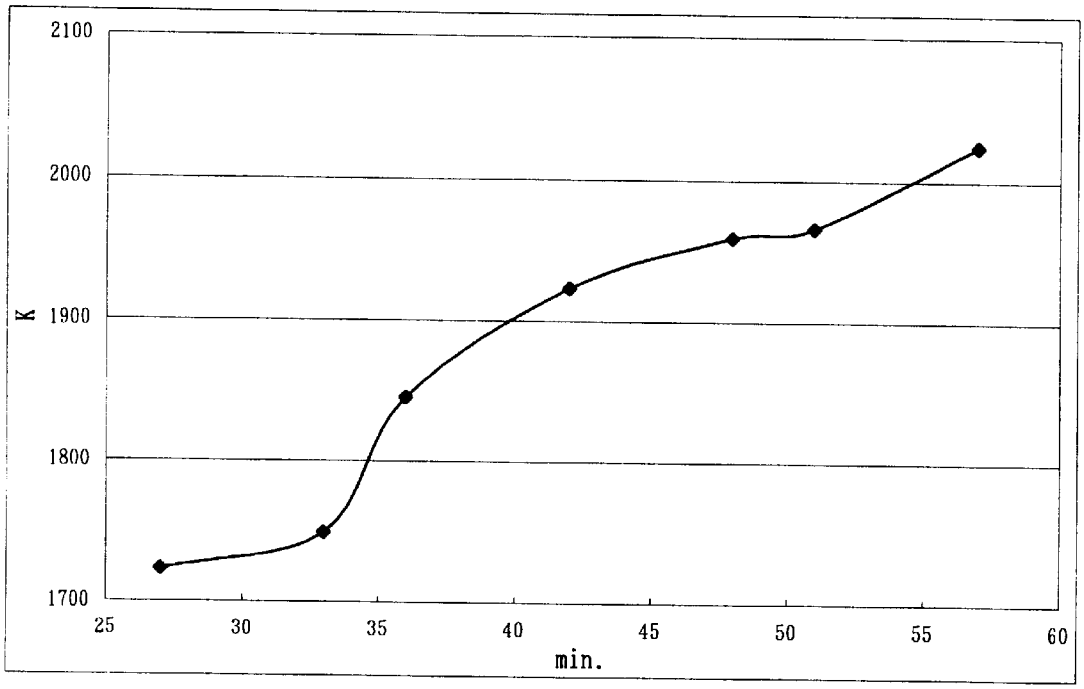
FIG. 22 is a graph showing the change of the melting temperature when casting the alloy of the composition of combination example 1.

Incidentally, in case of combination example 1, it gathered at 1723 K, 1789 K, 1845 K, and 1923 K (for comparative examples from 1 to 4, respectively), and 1959 K, 1966 K, and 2024 K (for embodiments from 1 to 3, respectively). In case of combination example 2, it gathered at 1789 K (for comparative example 5), and 2024 K (for comparative example 6). In case of combination example 3, it gathered at 1789 K (for comparative example 7), and 2024 K (for comparative example 8). In case of combination example 4, it gathered at 2024 K (for embodiments 4). Incidentally, the change of the melting temperature when casting the alloy of the composition of combination example 1 is shown in FIG. 22.

TABLE 1

| | C | V | P | S | Al | Ni | Si | Cr | Mn | Co | Fe + Impurities |
|---|---|---|---|---|---|---|---|---|---|---|---|
| Combination Example 1 | 3.0% | 10.0% | 0.1% | 0.03% | 0.5% | 9.0% | 1.5% | 18.0% | 0.7% | — | Remaining |
| Combination Example 2 | 3.0% | 10.0% | — | 0.01% | — | 9.0% | 1.5% | 18.0% | 0.7% | — | Remaining |
| Combination Example 3 | 3.0% | 10.0% | 0.2% | 0.1% | 1.5% | 9.0% | 1.5% | 18.0% | 0.7% | — | Remaining |
| Combination Example 4 | 3.0% | 10.0% | 0.1% | 0.03% | 0.5% | — | 1.5% | 18.0% | 0.7% | 9.0% | Remaining |

TEST EXAMPLE 1

Observation of Microstructure

Figure 21:
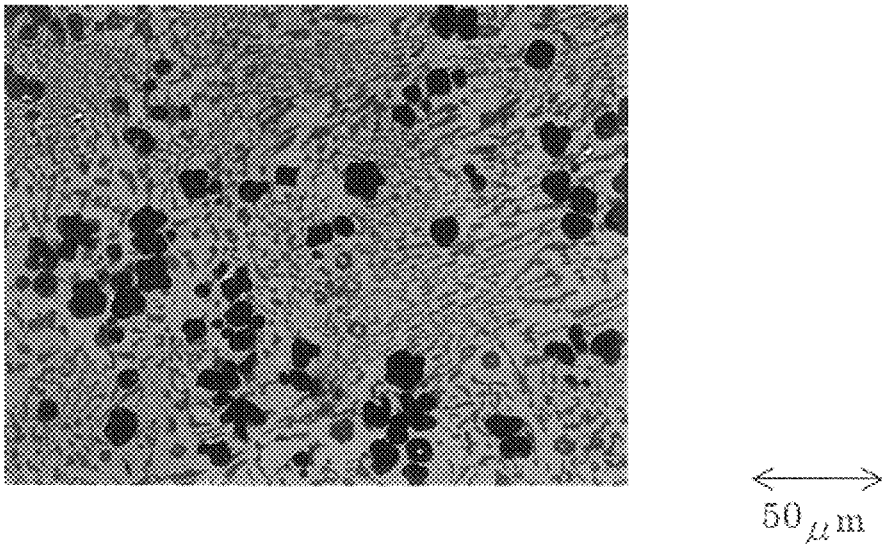
FIG. 21 is a micrograph of the metallic organization of embodiment 4, wherein 1.7 cm is actual 50 μm.

To observe a microstructure, a portion of 30 mm from the lower part of materials to be tested of embodiments from 1 to 4 and comparative examples from 1 to 8 were cut and were observed with the electronic microscope after abrasive. The reflected electron image of V C carbide was photographed. The results of comparative examples from 1 to 4 are shown in FIGS. from 10 to 13, respectively; the results of embodiments from 1 to 3 are shown in FIGS. from 14 to 16, respectively; the results of comparative examples from 5 to 8 are shown in FIGS. from 17 to 20, respectively; and the result of embodiment 4 is shown in FIG. 21.

FIGS. from 10 to 13 are the reflected electron image of the VC carbide when not reaching a fixed melting temperature. The black lump portion is VC carbide. As shown in the FIG, VC carbide presents lump like a starfish, and there are dotted part granularity is studded. By raising a melting temperature, the form of $M_7C_3$ at the base changes but it finds that the VC carbide has not become spheroidizing.

When the melting temperature rises into the effect range of the bubble assistant, the VC carbide changes spheroidally as shown in FIGS. from 14 to 16, in addition, $M_7C_3$ at the base is decreased and the spheroidal stabilization of the VC carbide becomes remarkable. Because the already generated the spheroidal VC carbide maintains the equilibrium state which is stable in molten metal, the spheroidal VC carbide in the organization does not change even in the casting solidification at the necessary casting temperature.

FIGS. from 17 to 20 are the reflected electron image of the VC carbide when the bubble assistant is out of the effect range. When there is not the bubble assistant, the VC carbide presents the lump like a starfish and rare granularity even if it reaches a fixed melting temperature. The VC carbide when the bubble assistant is excessive also presents the lump like a starfish and rare granularity, and it finds that plate like $M_7C_3$ separates a lot.

FIG. 21 is the organization when substituting all of Ni to Co. In order to substitute to Co, the γ phase by adding Co in the base and granular and lump $M_7C_3$ carbide are crystallized, but VC carbide becomes spheroidal. Under this condition, it is effective when abrasion-resistance is considered more than corrosion- resistance since the base hardness is increased. In either case, by maintaining bubble assistant and a fixed melting temperature properly the VC carbide can be spheroidal.

TEST EXAMPLES 2 and 3

Tensile Strength and Elongation

The tensile strength and the elongation of alloy cast iron obtained in said embodiments from 1 to 4 and in said comparative examples from 1 to 8 were tested. As for test pieces, "JIS Z 2201 No.4 test pieces for tensile test for metallic materials" were used according to "the shapes and measurements of common test sample (a) in JISG 0307 Steel Castings-General Technical Requirements. As a method of the test, said No.4 test pieces were used in order to measure both the tensile strength and the elongation in accordance with JIS Z 2241 standard of testing method for tensile strength of metallic materials.

TEST EXAMPLE 4

Impact Test

The impact of alloy cast iron obtained in said embodiments from 1 to 4 and in said comparative tests 1~8 were tested. JIS No.3 test pieces without notches in a shape of 10×10×55 mm wherein oxide on surfaces of the test pieces was taken away with a belt type abrasion system before Charpy impact test was carried out as for a method of test. Ruptured surfaces were observed wherein surfaces with defects were excluded.

The result of the impact test is shown in Tables 2 and 3.

TEST EXAMPLE 5

Measurement of Hardness

The hardness of alloy cast iron obtained in said embodiments from 1 to 4 and in said comparative tests from 1 to 8 were tested. "C scale ($H_RC$)" of "Rockwell hardness ($H_R$)" as an index was used in the test in accordance with "the method of Rockwell hardness test" as shown in "JISZ 2245" (i.e. In order to calculate the hardness with definite equation, differences between depths of indenter trespass at rated load before and after the test load is added onto the test piece can be measured within the following processes; firstly, a rated load is added onto a test piece, and further a test load is added, and then the test piece was brought back to with rated load again, using diamond indenters and spheroidal indenters.).

The results of the measurement of hardness are shown in Tables 2 and 3.

TEST EXAMPLE 6

Abrasion Test

Figure 23:
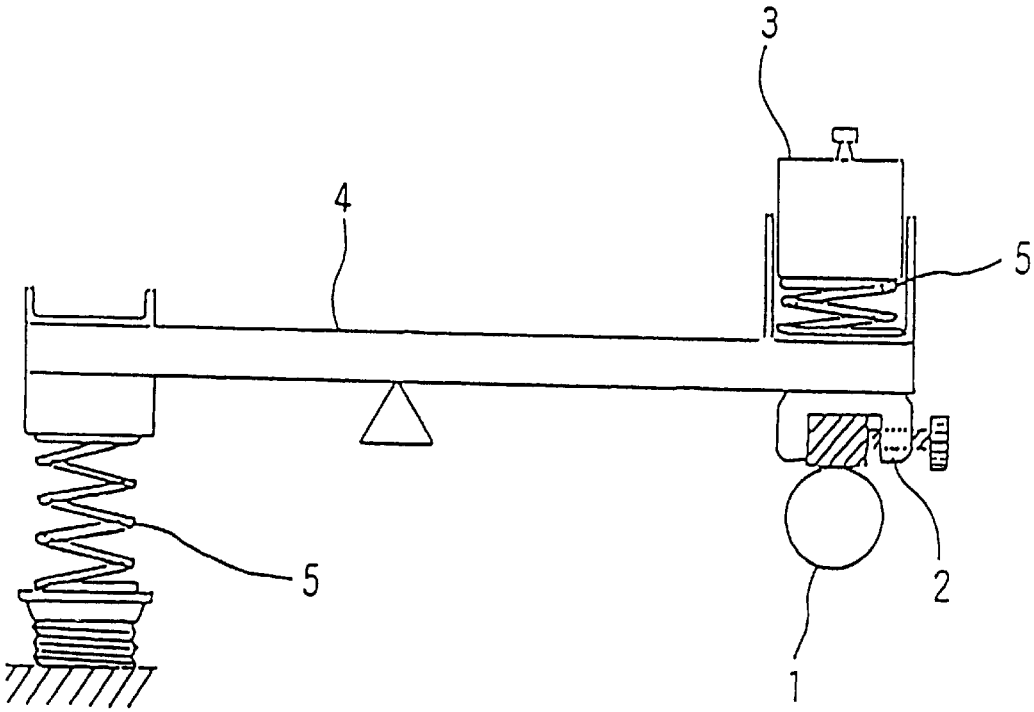
FIG. 23 is a schematic explanatory diagram of the abrasion tester used in test example 6.

Using the abrasion tester indicated in FIG. 23, the alloy cast iron obtained in said embodiments 1~4 and in said comparative test 1~8 was tested in the following process of abrasion test.

A stick of 10 mm height as a test piece was cut out from the common test sample of 25 mm square×50 mm height, and was fixed onto a screw holder (2), and then was cut down to 120 mm×120 mm height. Also, as for a grindstone contacting with the test piece, a grindstone shaped in ϕ25 mm×2 mm with #80 abrasive grain with a shaft comprising a sintered materials $Al_2O_3$ on the market at about 1473 K wherein about 30% of clay binder was mixed into was used.

Each surfaces of the test sample were abraded with #80 by using a belt-type abrader and with an attention paid especially with the surfaces where the grindstone touched to be leveled.

After confirming that there was no attachment on the surfaces of test sample, its weight was scaled with a precision balance as a pre-abrasion test weight.

Secondly, the test sample was put onto a holder portion with its test surface down, and a screw stopper was tightened from the sides with the test surface adjusted to be level using a level stand which is set at the same height as the grindstone.

After adjusting the balance of tester, 0.2 kg of weight for load (3) was put right above the test sample, and free running of the test sample was suppressed by installing a spring stopping swings (5) on the other side of the balance (4) to the test sample.

In this situation, the abrasion tester was started with its rotating speed at 1700 rpm. Within 90 seconds as its rotating time, dressing for preventing blinding of the grindstone with a shaft was done with a dressing grindstone at 30 and 60 seconds after starting.

After the test was over, the test sample wherein polishing powder attached onto the test sample was swept away was scaled with a precision balance again. The difference of the test sample weight of before and after the test was set as abraded amount.

The result of the abrasion test is shown in Tables 2 and 3.

TEST EXAMPLE 7

Corrosion-resistance Test

Using the alloy cast iron obtained in said embodiments from 1 to 4 and in said comparative tests from 1 to 8, the corrosion-resistance against $H_2SO_4$ (7N) and HCl (1N) was tested. As for a testing method, after a test sample of 10 $mm^3$ finished wholly (emery No. 320 finish) was degreasing washed, and its weight and surface area were measured. Each test piece was put separately into a 500 ml beaker wherein 300 ml of $H_2SO_4$ (7N) and HCl (1N) were poured into respectively. After the test piece in $H_2SO_4$ (7N) which was boiled and the test piece in HCl (1N) which was soaked in room temperature for 140 hours are washed and dried, the weight and surface area of each test piece were measured. Then, the loss in corrosion was measured in $mg/cm^2$.

In addition, corrosion-resistance test is carried out as same as above by using SUS304 which is said that is superior in corrosion-resistance. Furthermore, the composition of SUS304 is shown in Table 4.

The result of corrosion-resistance is shown in Tables 2 and 3.

TABLE 2

| | Embodiment 1 | Embodiment 2 | Embodiment 3 | Embodiment 4 |
|---|---|---|---|---|
| Tensile strength (Mpa) | 706 | 708 | 710 | 735 |
| Elongation (%) | 2.0 | 2.0 | 2.3 | 0.2 |
| Impact Value ($J/cm^3$) | 13.0 | 13.0 | 14.0 | 8.8 |
| Hardness ($H_RC$) | 40.6 | 40.4 | 40.0 | 61.0 |
| Abrasion | 1.85 | 1.82 | 1.75 | 1.37 |

TABLE 2-continued

| | Embodiment 1 | Embodiment 2 | Embodiment 3 | Embodiment 4 |
|---|---|---|---|---|
| Coefficient (mg) | | | | |
| Anticorrosion 7N-$H_2SO_4$ (mg/cm$^2$) | 3.76 | 3.75 | 3.72 | 9.36 |
| Anticorrosion 1N-HCl (mg/cm$^2$) | 2.68 | 2.65 | 2.66 | 5.07 |

TABLE 3

| | Comparative Example 1 | Comparative Example 2 | Comparative Example 3 | Comparative Example 4 | Comparative Example 5 | Comparative Example 6 | Comparative Example 7 | Comparative Example 8 | SUS-304 |
|---|---|---|---|---|---|---|---|---|---|
| Tensile strength (Mpa) | 525 | 544 | 548 | 595 | 571 | 606 | 510 | 520 | — |
| Elongation (%) | 0.0 | 0.0 | 0.0 | 0.0 | 0.0 | 0.0 | 0.0 | 0.0 | — |
| Impact Value (J/cm$^3$) | 4.2 | 4.2 | 4.4 | 4.5 | 4.5 | 6.2 | 4.7 | 3.8 | — |
| Hardness ($H_RC$) | 45.0 | 44.3 | 44.0 | 44.0 | 44.5 | 44.0 | 44.7 | 43.5 | — |
| Abrasion Coefficient (mg) | 5.26 | 4.50 | 4.38 | 3.34 | 4.10 | 4.00 | 5.08 | 4.50 | — |
| Anti-corrosion 7N-$H_2SO_4$ (mg/cm$^2$) | 5.74 | 5.65 | 5.66 | 5.63 | 6.71 | 6.63 | 7.68 | 7.38 | 19.92 |
| Anti-corrosion 1N-HCl (mg/cm$^2$) | 3.53 | 3.46 | 3.44 | 3.45 | 3.68 | 3.62 | 4.05 | 3.96 | 6.23 |

TABLE 4

| | C | Si | Mn | P | S | Ni | Cr | Fe + Impurities |
|---|---|---|---|---|---|---|---|---|
| SUS304 | 0.07% | 0.8% | 1.5% | 0.04% | 0.01% | 8.0% | 18.0% | Remaining |

As the results in Table 2 and Table 3, tensile strength, elongation impact value and abrasion coefficient improve by forming the spheroidal carbide. On the other hand, the hardness on the sample of embodiments from 1 to 3 decreases. The cause is thought that disappearing $M_7C_3$ and crystallizing the stable γ phase. The cause whereof the hardness of sample in embodiment 4 increases is thought as the difference of composition of base between Ni and Co. It finds that tensile strength, hardness and abrasion coefficient improves by substituting Ni to Co.

Further, the corrosion-resistance improves by forming the spheroidal carbide, whereas it decreases in embodiment 4 which has a different base. However, it has a superior corrosion-resistance than SUS304 has. Generally, it is known that corrosion-resistance decreases rapidly when C is included; however, superior corrosion-resistance can be maintained by crystallizing spheroidal carbide.

TEST EXAMPLE 8

Underwater Pump and Impeller Proving Test

An underwater pump and impeller as a drain treatment system of sludge storage tank were test proved. Actual usage of the sludge storage tank was pH 4~7 (design pH 7~9), and sand was mixed into as foreign material within the sludge. Also the concentration of the sludge was around 3%. The composition of said treatment system of sludge storage tank was analyzed with a fluorescent X-ray as, the concentration of sludge 0.5%, $FeSO_3$ 18.0%, $SO_3$ 6.1%, $Al_2O_3$ 4.2%, $SiO_2$ 8.8%, $V_2O_5$ 2.9%; and organic substance (C) 63.0%. Also, the demonstration value of pH was 5.0.

Impellers with outer diameter ϕ230 using the alloy cast iron of embodiment 2 and former cast iron FC200 as its material was made for the proving test in which the impeller was put onto the underwater pump for sludge treatment. As a result, 0.3% weight of the impeller made out of the alloy cast iron of embodiment 2 was reduced after 1,003 hours of running. On the contrary, 9.00% weight of the impeller made out of the former cast iron was reduced after 844 hours of running. Therefore, the abrasion-resistance and corrosion-resistance of the impeller made out of the alloy cast iron used for the embodiment was far better than those of the impeller made out of the former cast iron.

EFFECTS OF THE PRESENT INVENTION

As explained in detail above, the stainless spheroidal carbide cast iron in the invention, as set forth in claim 1 shows outstanding abrasion-resistance because the carbide crystallized inside of the organization thereof is made to be in spheroidal shape. Also, as mentioned previously, it can show the corrosion-resistance and heat-resistance which are equal to those of stainless steel because the carbide is made to be in spheroidal shape.

The stainless spheroidal carbide cast iron in the invention as set forth in claim 2 has the outstanding abrasion-resistance and heat-resistance, and is able to improve its corrosion-resistance largely.

The stainless spheroidal carbide cast iron in the invention as set forth in any one of claims 3 and 4 has the outstanding abrasion-resistance and heat-resistance, and is able to improve its corrosion-resistance largely.

The stainless spheroidal carbide cast iron in the invention as set forth in any one of claims 5 and 6 has the outstanding abrasion-resistance and heat-resistance, and is able to improve its corrosion-resistance largely.

What is claimed is:

1. Stainless spheroidal carbide cast iron:

comprising of Fe as its main component, C 0.6~4.0% and V 4~15% as its necessary components, P 0.01~0.15%, S 0.01~0.05%, and Al 0.05~1.0% as bubble assistants, and Ni 4~15%, Si 0.2~4.5%, Cr 13~30%, and Mn 0.2~1.5% as anticorrosion matrix formers in weight %;

produced by the process that minute spheroidal space of gas (hydrogen) bubble is dispersed substantially equally into molten metal positively by high temperature melting at 1950~2073 K which is the bubbling reaction temperature, and spheroidal vanadium carbide of a covalent bond is crystallized inside of the spheroidal space.

2. Stainless spheroidal carbide cast iron:

comprising of Fe as its main component, C 0.6~4.0% and V 4~15% as its necessary components, P 0.01~0.15%, S 0.01~0.05%, and Al 0.05~1.0% as bubble assistants, and Si 0.2~4.5%, Cr 13~30%, Mn 0.2~1.5%, and Ni and/or Co 4~15% as anticorrosion matrix formers in weight %;

produced by the process that minute spheroidal space of gas (hydrogen) bubble is dispersed substantially equally into molten metal positively by high temperature melting at 1950~2073 K which is the bubbling reaction temperature, and spheroidal vanadium carbide of a covalent bond is crystallized inside of the spheroidal space.

3. Stainless spheroidal carbide cast iron as set forth in claim 1 comprising a mixture of said alloy elements and at least more than one kind selected from additives (a)~(d) as follows: (a) Mo 0.05~15%; (b) Ti 0.01~5%; (c) B 0.01~2%; and (d) at least more than two kinds of alloy elements selected from Cu, W, Zr, Co, Nb, Ta and Y 0.2~5%.

4. Stainless spheroidal carbide cast iron as set forth in claim 2 comprising a mixture of said alloy elements and at least more than one kind selected from additives (a)~(d) as follows: (a) Mo 0.05~15%; (b) Ti 0.01~5%; (c) B 0.01~2%; and (d) at least more than two kinds of alloy elements selected from Cu, W, Zr, Co, Nb, Ta and Y 0.2~5%.

5. Stainless spheroidal carbide cast iron as set forth in claim 1 comprising a mixture of said alloy elements and at least more than one kind selected from additives (a)~(d) as follows: (a) Mo 0.05~5%; (b) Ti 0.01~1.0%; (c) B 0.01~0.5%; (d) at least more than two kinds of alloy elements selected from Cu, W, Zr, Co, Nb, Ta and Y 0.2~10%.

6. Stainless spheroidal carbide cast iron as set forth in claim 2 comprising a mixture of said alloy elements and at least more than one kind selected from additives (a)~(d) as follows: (a) Mo 0.05~5%; (b) Ti 0.01~1.0%; (c) B 0.01~0.5%; (d) at least more than two kinds of alloy elements selected from Cu, W, Zr, Co, Nb, Ta and Y 0.2~10%.

* * * * *